US005906299A

United States Patent [19]

Hagleitner

[11] Patent Number: 5,906,299

[45] Date of Patent: May 25, 1999

[54] SOAP FOAM DISPENSER

[75] Inventor: Hans Georg Hagleitner, Zell am See, Austria

[73] Assignee: Hagleitner Betriebshygiene GES.M.B.H. & Co. KG, Austria

[21] Appl. No.: 08/875,009

[22] PCT Filed: Mar. 26, 1996

[86] PCT No.: PCT/AT96/00061

§ 371 Date: Jul. 16, 1997

§ 102(e) Date: Jul. 16, 1997

[87] PCT Pub. No.: WO96/29921

PCT Pub. Date: Oct. 3, 1996

[30] Foreign Application Priority Data

Mar. 29, 1995 [AT] Austria ..... 563/95

[51] Int. Cl.[6] ..... B65B 1/04

[52] U.S. Cl. ..... 222/190; 222/321.7; 222/181.3

[58] Field of Search ..... 222/190, 321.1, 222/321.7, 321.8, 255, 381, 325, 145.5, 145.6, 181.1, 181.3; 239/418, 426, 433, 434

[56] References Cited

U.S. PATENT DOCUMENTS

| | | | |
|---|---|---|---|
| 3,580,863 | 5/1971 | Campbell et al. | 252/359 |
| 4,349,131 | 9/1982 | Arabian | 222/190 |
| 5,169,029 | 12/1992 | Behar et al. | 222/145.6 |
| 5,445,288 | 8/1995 | Banks | 222/95 |
| 5,570,819 | 11/1996 | Uehira et al. | 222/190 |

FOREIGN PATENT DOCUMENTS

| | | |
|---|---|---|
| 0 019 582 | 12/1980 | European Pat. Off. . |
| 2 397 341 | 9/1979 | France . |
| 94 07 178 | 7/1994 | Germany . |
| 676 227 | 12/1990 | Switzerland . |

*Primary Examiner*—Steven O. Douglas
*Attorney, Agent, or Firm*—Hale and Dorr LLP

[57] ABSTRACT

A soap foam dispenser which includes a metering pump and an air pump having pistons that are arranged in a mutually parallel relationship. An actuating lever for the dispenser is arranged so that it is movable in a direction of displacement of the two pistons. A movable housing cover serves as the actuating lever and is movable in a direction of the travelling path of the two pistons.

8 Claims, 2 Drawing Sheets

SOAP FOAM DISPENSER

BACKGROUND OF THE INVENTION

The invention concerns a soap foam dispenser having a storage container for a soap solution, a metering pump for the soap solution, an air pump for the feed of foaming air, and a movable actuating lever for simultaneous actuation of both pumps.

A soap foam dispenser of that kind is to be found for example in EP-A-19 582. A hand lever which is arranged beneath the dispenser and which is to be pulled towards the user is pivotably connected to the pistons of the two pumps, the piston of the metering pump being displaced horizontally and the piston of the air pump being displaced vertically.

Now the object of the present invention is to improve the actuating mechanism of the two pumps and for that purpose the invention proposes that the two pumps have pistons which are arranged in mutually parallel relationship and the actuating lever is movable in the direction of displacement of the two pistons. That arrangement therefore eliminates the actual hand lever and the coupling elements connecting it to the two pump pistons and the overall structure is simplified.

SUMMARY OF THE INVENTION

In a preferred embodiment, touching the device with the hands when they have not yet been cleaned can be avoided by the actuating lever being formed by a movable housing cover. The housing cover represents a sufficiently large operating element which can be actuated not only by hand but also with the back of the hand, the forearm, the elbow etc.

Preferably the housing cover is suspended pivotably about a horizontal axis and the two pistons are displaceable horizontally. The two pumps are preferably arranged in mutually superposed relationship, while the length of the travel of at least one piston can be adjustable.

Preferably the air pump is arranged between the storage container and the metering pump. That requires a communication between the storage container disposed above the air pump and the metering pump disposed beneath the air pump. A particularly advantageous arrangement is afforded in that respect if a communicating tube between the storage container and the metering pump forms an abutment for the piston of the air pump. If the piston of the air pump is subjected to the force of a return spring, the communicating tube limits in particular the return travel. Irrespective of a return spring the communicating tube can also serve as an abutment for both piston travels if the piston has a piston plate and, at a spacing relative thereto, an actuating head, and the communicating tube is passed through between the piston plate and the actuating head.

Use of the communicating tube between the storage container and the metering pump as an abutment for the piston travel of the air pump is moreover not limited to use of the housing cover as a common actuating element but could also be employed in relation to other actuating elements, for example by way of a hand lever.

BRIEF DESCRIPTION OF THE DRAWINGS

The invention will now be described in greater detail hereinafter with reference to the Figures of the accompanying drawing in which.

DETAILED DESCRIPTION OF THE PREFERRED EMBODIMENTS

Figure 1:
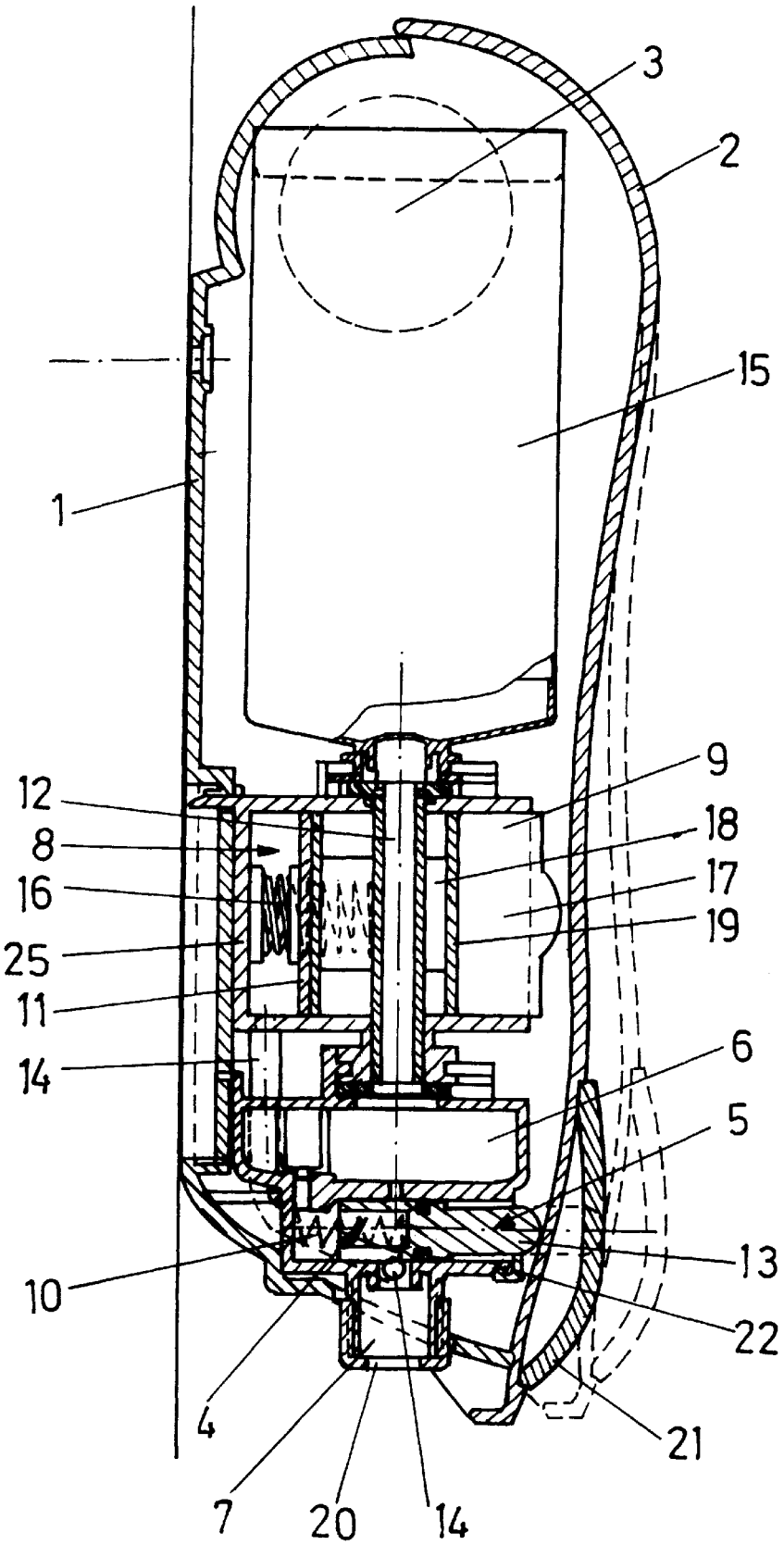
FIG. 1 is a view in vertical section through a soap foam dispenser.
Figure 2:
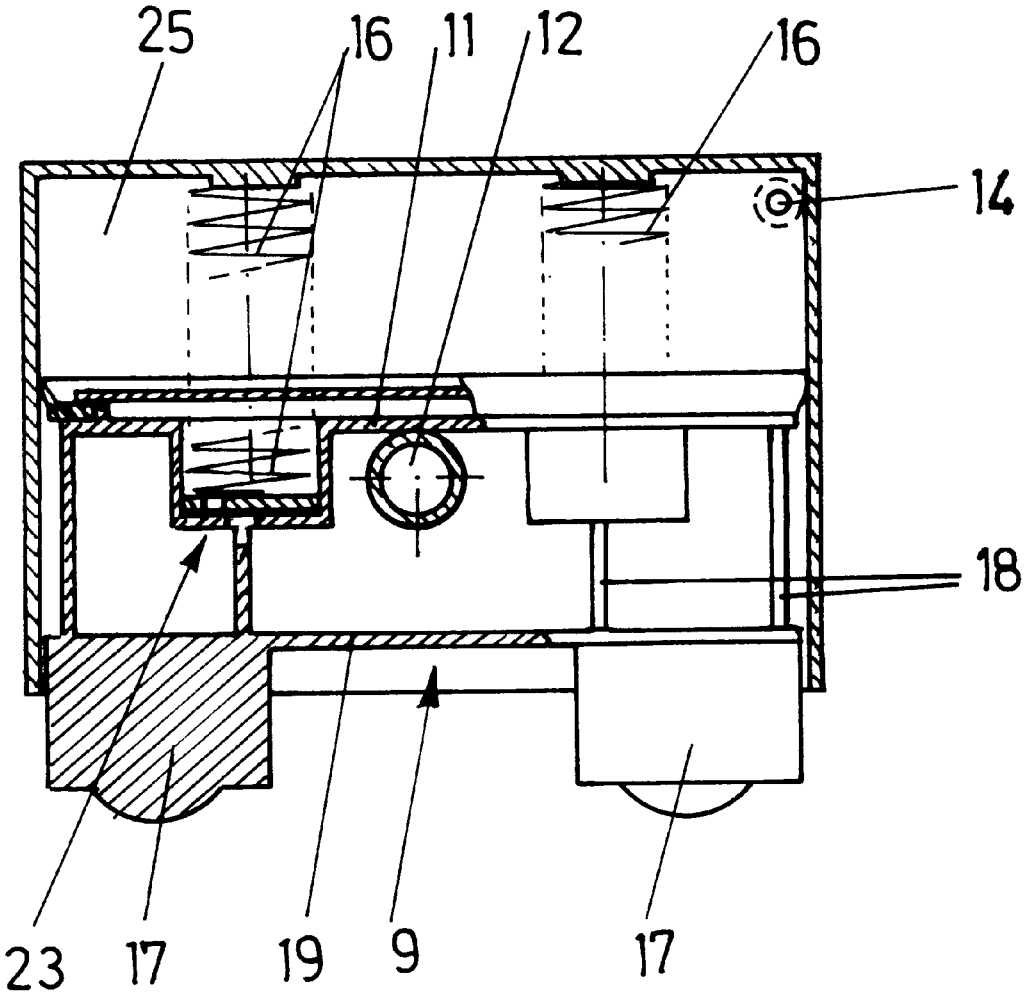
FIG. 2 is a view in horizontal section through the air pump.

The soap foam dispenser has a housing 1 which can be fixed for example to a wall and on which a cover 2 is arranged pivotably about an upper horizontal axis 3. Soap foam issues from a lower outlet 20 provided on a foaming chamber 7 in which air is added to the liquid soap and the air and the soap are mixed. The liquid soap flows from an in particular interchangeable storage container 15 arranged in the upper part of the housing 1 by way of a communicating tube 12 into a collecting space 6 and is introduced from same by means of a metering pump 4, in the respectively desired amount, into the foaming chamber 7. The air required for foam production purposes is produced by means of an air pump 8 from which an air conduit 14 communicates with the foaming chamber 7 which includes a non-return valve and a filter insert for foam production. The two pumps 4, 8 are stroke piston pumps and are so disposed in the housing 1 that the pistons 5 and 9 are horizontally displaceable in mutually superposed parallel relationship. Each piston 5, 9 is urged towards the rest position by a return spring 10, 16 and is disposed in that rest position with its front end 13, 17, that is towards the user, against the cover 2 of the housing 1. The rest positions are shown in broken lines in FIG. 1. In that situation the communicating tube 12 between the storage container 15 and the collecting space 6 serves as an abutment for the piston plate 11 of the air piston 9. As the communicating tube 12 is arranged approximately centrally in the housing 1, a respective limb portion 18 extends forwardly at each side of the communicating tube 12 and the limb portions 18 are connected to a front plate 19 on which two actuating heads 17 of the piston 9 are arranged. Accordingly the arrangement preferably also has two return springs 16 which bear against the rear wall of the air pump housing 25.

If soap foam is to be taken from the dispenser, pressure is applied to the cover 2 for example at the location with a marking element 21, and that can be effected not only with the palm of the hand but also with the back of the hand or the forearm. That moves both pistons 5, 9 simultaneously, in which case the piston 5 of the metering pump 4 delivers a portion of soap from the collecting space 6 into the foaming chamber 7 and the piston 9 of the air pump 8 delivers the required air into the foaming chamber 7 by way of the air conduit 14. The required air inlet valve is formed in particular by two flap valves 23 on the piston plate 11.

In the rest position the piston 5 bears against an abutment provided on a retaining element 22 which can be fitted on to the cylinder of the metering pump 4. Instead of that retaining element it would also be possible to use the air conduit 14 as the abutment for the rest position, if the air conduit 14, like the communicating tube 12 in the region of the air pump 8, has a portion which passes through the cylinder of the metering pump 4.

I claim:

1. A soap foam dispenser comprising a housing, a storage container for a soap solution, a metering pump for the soap solution, an air pump for the feed of foaming air, the two pumps having reciprocally travelling pistons which are arranged in parallel relationship and displaceable horizontally, a foaming chamber arranged below said two pumps and connected to said metering pump and said air pump, said foaming chamber being provided with a foam outlet, and an actuating lever for simultaneous actuation of both pumps, which is movable in the direction of the travelling path of the two pistons.

2. A soap foam dispenser comprising a housing, a storage container for a soap solution, a metering pump for the soap solution, an air pump for the feed of foaming air, the two pumps having reciprocally travelling pistons which are arranged in parallel relationship and displaceable horizontally, and an actuating lever for simultaneous actuation of both pumps, said actuating lever being movable in the direction of the travelling path of the two pistons and embodied as a front wall of the housing having an upper horizontal axis, said front wall being suspended pivotally about the horizontal axis of the housing.

3. A soap foam dispenser as set forth in claim 2 wherein the length of the travelling path of at least one of said two pistons is adjustable.

4. A soap form dispenser comprising a housing, a storage container for a soap solution, a metering pump for the soap solution, an air pump for the feed of foaming air, said air pump being arranged between the storage container and the metering pump, the two pumps having reciprocally travelling pistons which are arranged in parallel relationship, an actuating lever for simultaneous actuation of both pumps, said actuating lever being movable in the direction of the travelling path of the two pistons, and a communicating tube from the storage container to the metering pump, said tube forming an abutment for the piston of the air pump.

5. A soap foam dispenser as set forth in claim 4 wherein the piston of the air pump is acted upon by a return spring, the communicating tube limiting the travelling path.

6. A soap foam dispenser as set forth in claim 4 wherein the piston has a piston plate and at a spacing relative thereto an actuating head, the communicating tube passing through between the piston plate and the actuating head.

7. A soap foam dispenser as set forth in claim 4 wherein the metering pump is arranged between the air pump and a foaming chamber, said soap foam dispenser further comprising an air conduit from the air pump to the foaming chamber, said conduit forms an abutment for the piston of the metering pump.

8. A soap foam dispenser as set forth in claim 1 wherein the actuating lever is embodied as a front wall of the housing having an upper horizontal axis, said front wall being suspended pivotally about the horizontal axis of the housing.

* * * * *